United States Patent [19]

Campagnuolo

[11] Patent Number: 4,503,774

[45] Date of Patent: Mar. 12, 1985

[54] SELF-REGULATING AIR DRIVEN POWER SUPPLY

[75] Inventor: Carl H. Campagnuolo, Potomac, Md.

[73] Assignee: The United States of America as represented by the Secretary of the Army, Washington, D.C.

[21] Appl. No.: 490,266

[22] Filed: May 2, 1983

[51] Int. Cl.[3] ..... F42C 11/00; F15C 1/08

[52] U.S. Cl. ..... 102/207

[58] Field of Search ..... 102/207

[56] References Cited

U.S. PATENT DOCUMENTS 3,568,704 3/1971 Campagnuolo et al. ..... 310/15

3,792,664 2/1974 Campagnuolo ..... 102/207

3,861,313 1/1975 Campagnuolo et al. ..... 102/207

4,362,106 12/1982 Campagnuolo et al. ..... 102/207

*Primary Examiner*—Charles T. Jordan

*Attorney, Agent, or Firm*—Anthony T. Lane; Robert P. Gibson; Saul Elbaum

[57] ABSTRACT

A plurality of control jets is provided in the nozzle-centerbody of an air driven resonator to deflect portions of the incoming air flow away from the resonator. The control jets operate so as to deflect major portions of the air flow during high velocity flight, while not substantially deflecting the air inflow during low velocity flight.

15 Claims, 4 Drawing Figures

LOW VELOCITY FLOW

HIGH VELOCITY FLOW

SELF-REGULATING AIR DRIVEN POWER SUPPLY

RIGHTS OF THE GOVERNMENT

The invention described herein may be manufactured and used by or for the United States Government for Government purposes without payment to me of any royalty thereon.

BACKGROUND OF THE INVENTION

It is known in the prior art to combine an air driven power supply, such as a fluidic generator, with a projectile fuze. See, for example, U.S. Pat. Nos. 3,568,704; 3,772,541; and 3,971,321. When such a device is positioned in the fuze ogive of a projectile or missile, ram air enters through an air inlet means and passes through a nozzle. The nozzle, which contains a nozzle-centerbody, directs the air to a resonant cavity. The air entering the resonant cavity produces acoustical vibrations. The acoustical vibrations cause a daphragm, which is mounted in the resonant cavity, to oscillate. The oscillating diaphragm drives a metallic reed which is set in a permanent magnetic field. This induces a current in a coil, which is used to power the fuze electronics.

When an air driven generator, of the type just described, is used aboard a projectile, it can experience velocities of 3000 feet per second or higher. These high flight velocities cause a large mass flow to enter the air inlet of the generator. The large mass flows cause the diaphragm to experience large displacements. When the displacement of the diaphragm is large enough, a condition is reached where the metallic reed bangs against the pole pieces of the magnetic device. This banging causes noise in the electrical output and, more importantly, fatigues the reed, which will eventually break causing a power loss in the fuze electrical system.

Prior attempts to regulate the flow of air into the fuze comprise mainly movable valves which responded to such variables as acceleration, air pressure, etc. Such devices met with limited success as they were highly sensitive and required delicate calibrations. Also, the high magnitude of mechanical forces experienced by the devices, as well as aerodynamic heating, resulted in many failures and a low degree of dependability.

One method to regulate the air flow into the fuze is to provide an air deflector in the air inlet means of a fuze ogive. See U.S. Pat. No. 4,362,106. There, the deflector comprises a stationary deflecting surface configured so as to substantially reduce the amount of air entering the ogive during high velocity flight, while not substantially reducing the air inflow during low velocity flight.

It is an object of this invention to provide a device which produces control jets to deflect portions of the incoming air flow away from the resonator.

It is a further object of this invention to provide a device which will deflect major portions of the incoming air flow during high velocity flight.

It is also an object to provide such a device which would not substantially affect the inflow of the air to the resonator during low velocity flight period.

It is a further object of this invention to use a plurality of air passageways in the nozzle-centerbody to produce the control jets.

It is a further object of this invention to provide a device for producing control jets which is simple, inexpensive, and has no moving parts requiring calibration.

It is an additional object of the invention to provide such a device which has infinite shelf life, not experiencing any degree of deterioration in storage.

SUMMARY OF THE INVENTION

Briefly, in accordance with the invention, an air driven resonator is provided which comprises an enclosed volume having an open end and a closed end, which defines a resonant cavity. A tubular air inlet containing a cylindrical nozzle-centerbody is positioned ahead of the resonator. The tubular air inlet in combination with the cylindrical nozzle centerbody defines an annular orifice which directs an annular column of air into the resonant cavity. A plurality of air passageways is provided in the nozzle-centerbody to produce control jets to deflect portions of the incoming air flow away from the resonator.

DESCRIPTION OF A PREFERRED EMBODIMENT

Figure 1:
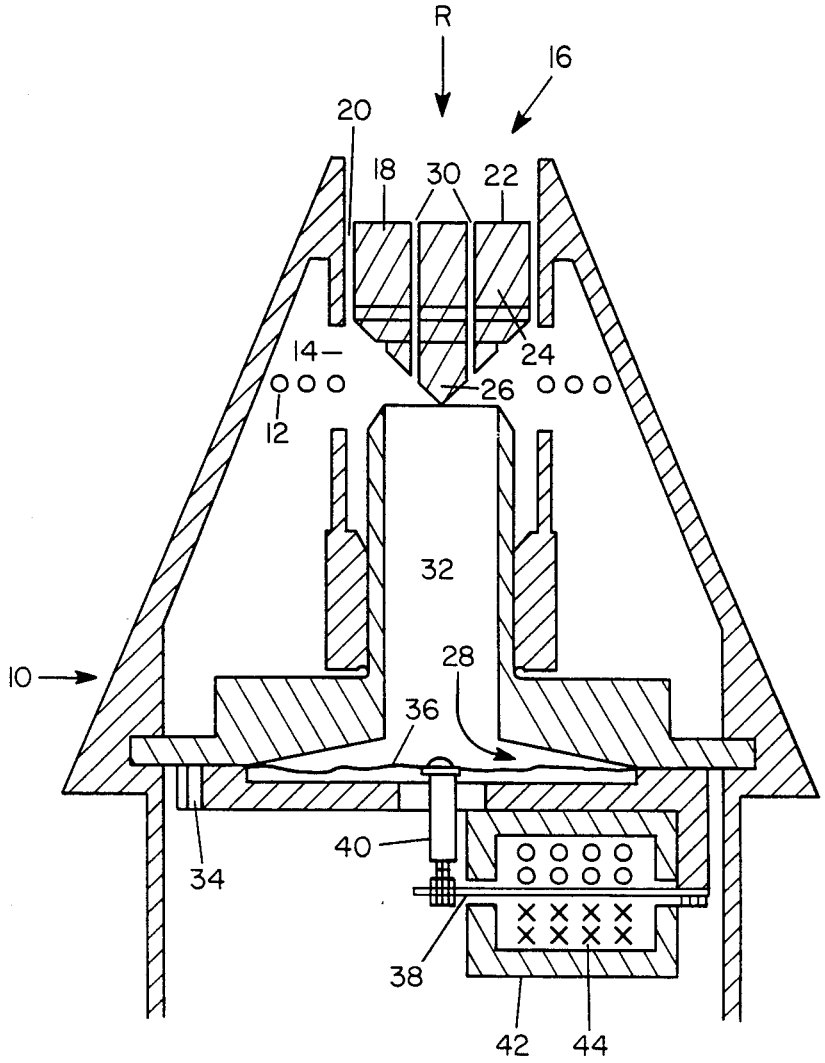
FIG. 1 illustrates a self-regulating air driven power supply of the present invention in combination with an embodiment of a fuze ogive suitable for use with it.

FIG. 1 represents a conventional fuze ogive 10. Ventilating holes 12 and ventilating slots 14 are provided in the ogive 10. Air inlet tube 16 allows ram air, as designated by arrow R, to enter the fuze. Mounted inside of the air inlet tube 16 is a cylindrical nozzle-centerbody 18 having a smaller diameter than that of the air inlet tube, and forming an annular orifice 20. The nozzle-centerbody 18 comprises a flat face 22, facing the incoming air stream, a solid cylindrical segment 24, and a come segment 26 facing the resonant cavity 28. Air passageways 30 are positioned in the nozzle-centerbody 18. The annular column of air emerging from the annular orifice 20 and air passageways 30 are directed into air channel 32. The air enters resonant cavity 28, causing acoustical vibrations. Air entering resonant cavity 28 may be vented therefrom by means of vents 34 provided around the periphery of the diaphragm 36. The vents 34 communicate with the resonant cavity 28 by means not shown.

The acoustical vibrations cause diaphragm 36 to oscillate. The diaphragm 36 forms the other end of resonant cavity 28. The vibrations of diaphragm 36 are transmitted to reed 38 by means of post 40 which is connected to diaphragm 36. Reed 38 is thereby oscillated within the magnetic field of the magnetic device 42, inducing a current in coil 44. This current is conventionally used to power the fuze electronics. As discussed above, when the mass flow or pressure of the ram air entering the fuze becomes excessive, the magnitude of the motion and the forces imposed on the diaphragm of the fluidic generator often become great enough to cause damage to the generator.

The present invention solves this problem by the use of a plurality of air passageways 30 positioned in the nozzle-centerbody 18. This is done by using the air passageways 30 to produce control jets which deflect portions of the incoming air flow away from the resonant cavity 28.

Figure 2:
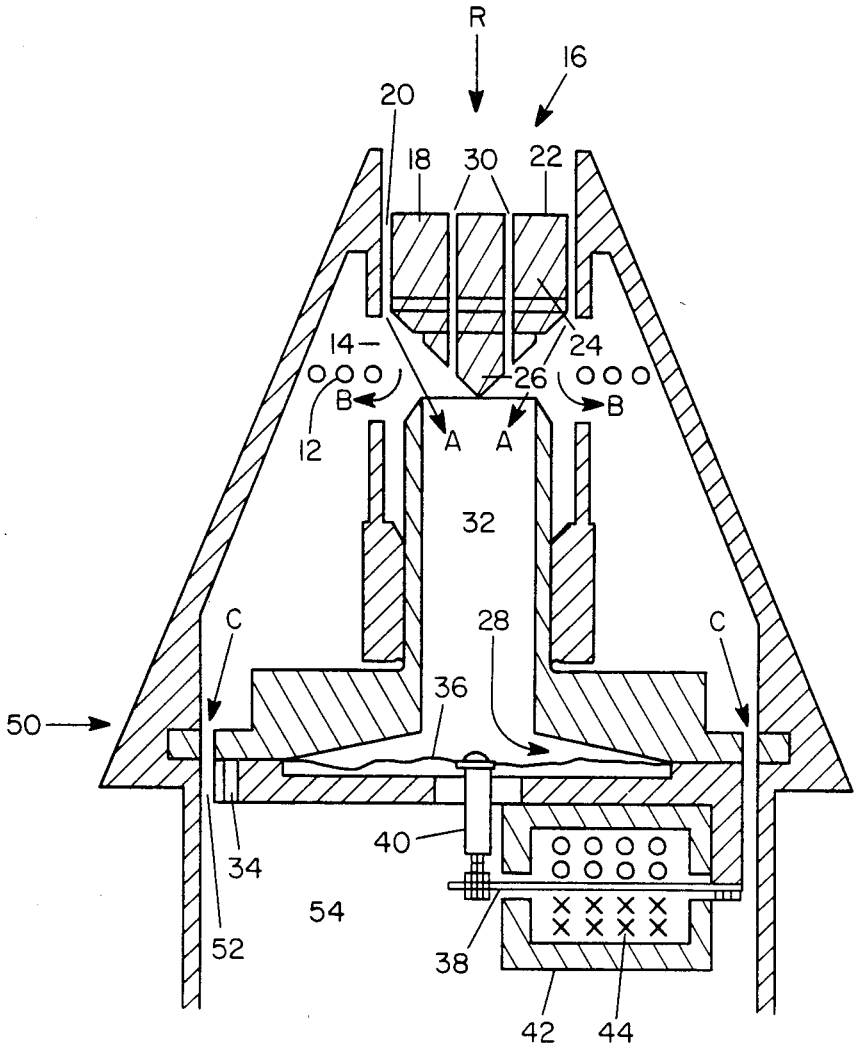
FIG. 2 is the same as FIG. 1 except for the addition of bleed-hole means within the fuze ogive.

FIG. 2 is the same as FIG. 1 except for the addition of bleed-holes 52 within the fuze ogive 50. Elements of the fuze structure as shown in FIG. 2 which correspond to those of FIG. 1 are correspondingly numbered. The bleed-holes 52 may be provided within the fuze ogive in order to equalize the pressure on opposite sides of the diaphragm 36. This will substantially reduce the likelihood of imposing excessive stresses on the diaphragm of the fluidic generator.

A portion of the air passing through annular ofifice 20 will pass through the air channel 32 to the resonant cavity 28, as indicated by arrows A. The excess flow will pass through ventilating slots 14, as indicated by arrows B. Rather than merely being expelled through the vent holes 12, as in the device of FIG. 1, a portion of flow B will pass through bleed-holes 52, as shown by arrow C. This will tend to increase the air pressure in the region 54 on the opposite side of diaphragm 36, thereby reducing the likelihood that extreme, unbalanced forces will be imposed on the diaphragm. This further reduces the likelihood of damage to the fluidic generator.

Figure 3:
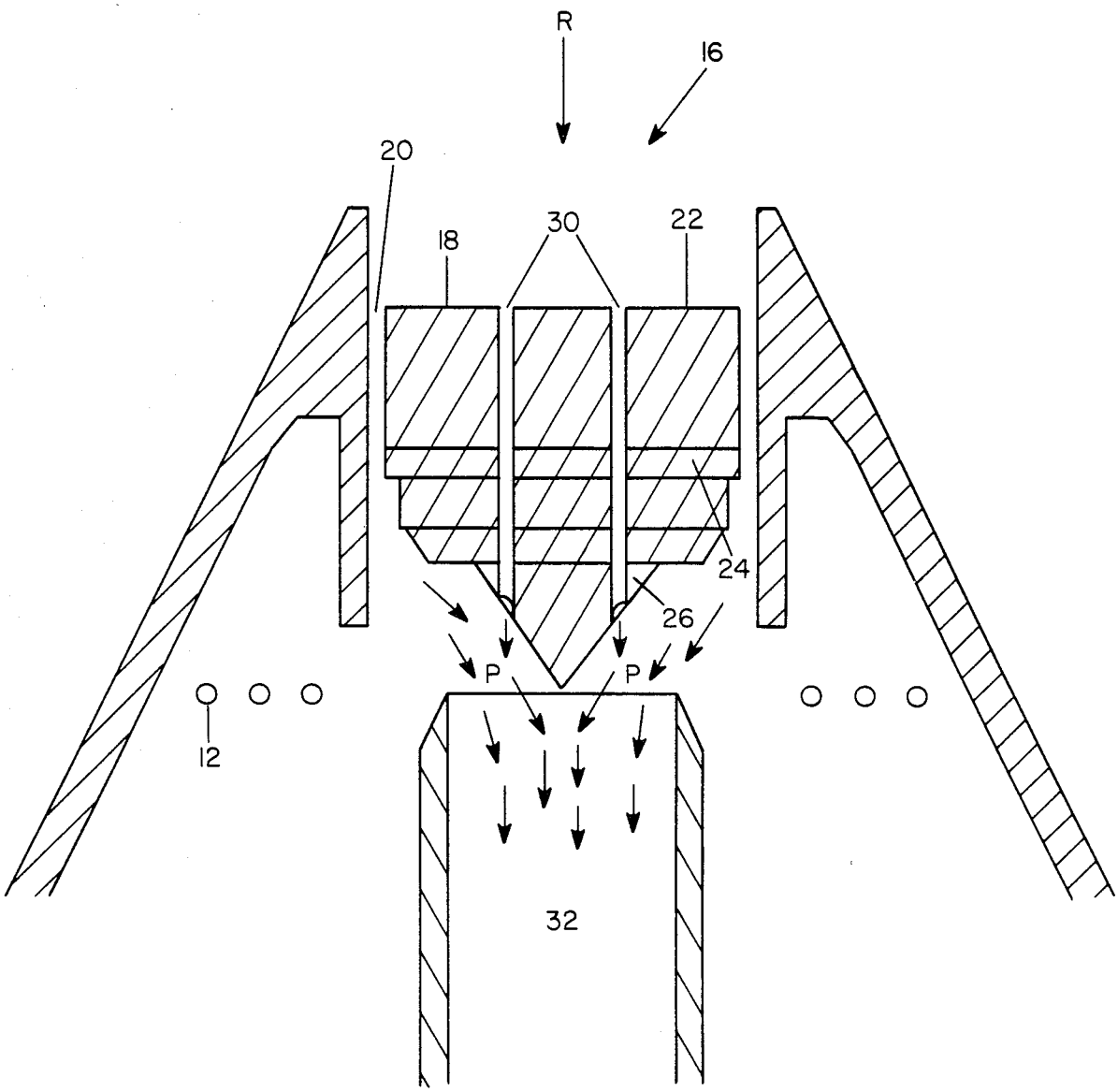
FIG. 3 is an enlarged view of the foremost portion of the fuze of FIG. 1, illustrating the mode of operation of the present invention at low velocity air flows.

FIG. 3 illustrates the manner of operation of the present invention at low velocity air flows. Elements of the fuze structure as shown in FIG. 3 which correspond to those of FIG. 1 are correspondingly numbered. At low velocities ram air R will enter the inlet tube 16 and proceed simultaneously through annular nozzle 20 and air passageways 30. The two flows will intersect at point P, where they combine, and then proceed through air channel 32 to the resonant cavity 28. This occurs for two reasons. First, because the flow over the nozzle-centerbody 18 is not separated the jet outer streamlines are collapsed to form an integral jet. Second, because the region where the jet outer streamlines meet is a low pressure zone at low velocities the intersecting flows will combine and then proceed to the resonant cavity 28.

Figure 4:
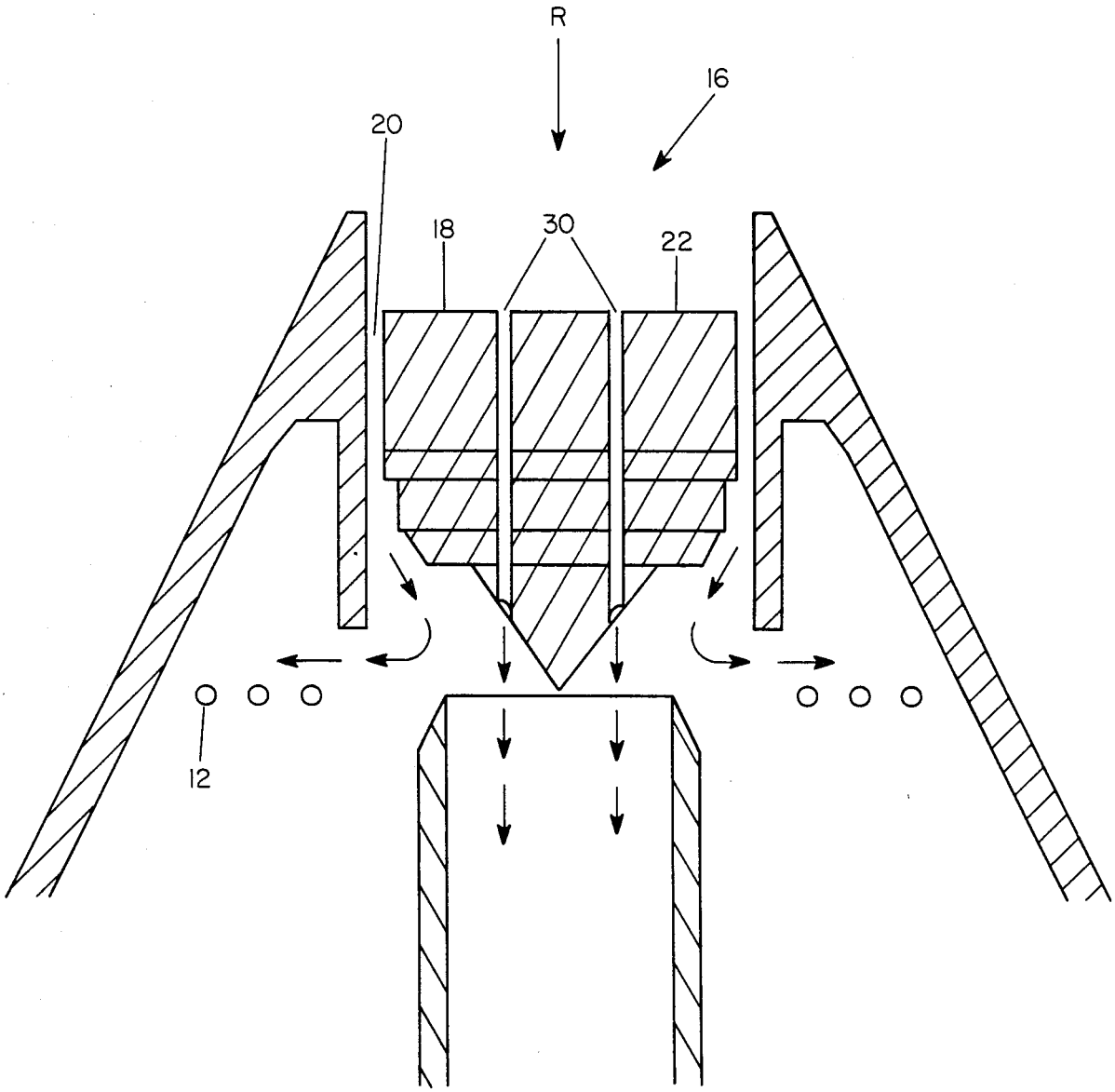
FIG. 4 is an enlarged view of the foremost portion of the fuze of FIG. 1, illustrating the mode of operation of the present invention at high velocity air flows.

FIG. 4 illustrates the manner of operation of the present invention at high velocity air flows. Elements of the fuze structure as shown in FIG. 4 which correspond to those of FIG. 1 are correspondingly numbered. At high velocities ram air R will enter the inlet tube 16 and proceed simultaneously through annular nozzle 20 and air passageways 30. But now, according to the well known fluid jet momentum exchange principle, the flow from the air passageways 30 and that from annular nozzle 20 will intersect in such a manner that a substantial portion of the annular flow is diverted away from the resonant cavity 28 to the ventilating slots 14. The portion of the flow entering the cavity is thus substantially reduced. Hence, the forces acting on the vibrating parts of the fluidic generator are substantially reduced.

While the invention has been described with reference to the accompanying drawings, I do not wish to be limited to the details shown therein as obvious modifications may be made by one of ordinary skill in the art.

I claim:

1. An air driven resonator comprising:

a. an enclosed volume having an open end and a closed end and defining a resonant cavity;

b. a tubular air inlet means having a first diameter for allowing air to enter the resonant cavity;

c. a cylindrical nozzle-centerbody having a second diameter smaller than the first diameter and positioned within the air inlet means to form an annular orifice to direct an annular column of air into the resonant cavity; and d. a plurality of air passageways passing through said nozzle-center body for producing control jets to deflect portions of the air flow away from the resonant cavity.

2. The invention of claim 1 wherein the nozzle-centerbody comprises a flat side facing the air inlet means, a solid cylindrical segment of a predetermined length, and a cone segment facing the resonant cavity.

3. The invention of claim 2 wherein the plurality of air passageways pass through the nozzle-centerbody starting at the flat face and ending in the cone segment.

4. The invention of claim 3, further comprising a power generating means.

5. The invention of claim 4 wherein the power generating means comprises a diaphragm means which is driven by air entering the air inlet means and contacting the diaphragm means.

6. The invention of claim 5 wherein the diaphragm means is driven by air contacting a first portion thereof, and further comprising means to divert a portion of the air entering the resonator to a second portion of the diaphragm to balance forces applied to the diaphragm means.

7. The invention of claim 6 wherein the means to divert a portion of the air entering the resonator comprises a means for venting connecting regions on opposite sides of the diaphragm means.

8. The invention of claim 1, further comprising a power generating means.

9. The invention of claim 8, wherein the power generating means comprises a diaphragm means which is driven by air entering the air inlet means and contacting the diaphragm means.

10. The invention of claim 9, wherein the diaphragm means is driven by air contacting a first portion thereof, and further comprising means to divert a portion of the air entering the resonator to a second portion of the diaphragm to balance forces applied to the diaphragm means.

11. The invention of claim 10 wherein the means to divert a portion of the air entering the resonator comprises a means for venting connecting regions on opposite sides of the diaphragm means.

12. The invention of claim 2, further comprising a power generating means.

13. The invention of claim 12, wherein the power generating means comprises a diaphragm means which is driven by air entering the air inlet means and contacting the diaphragm means.

14. The invention of claim 13 wherein the diaphragm means is driven by air contacting a first portion thereof, and further comprising means to divert a portion of the air entering the resonator to a second portion of the diaphragm to balance forces applied to the diaphragm means.

15. The invention of claim 14 wherein the means to divert a portion of the air entering the resonator comprises a means for venting connecting regions on opposite sides of the diaphragm means.

* * * * *